US007134555B2

(12) United States Patent
Wise

(10) Patent No.: US 7,134,555 B2
(45) **Date of Patent: *Nov. 14, 2006**

(54) APPARATUS FOR ISOLATING MATERIALS

(75) Inventor: Richard J. Wise, Kelowna (CA)

(73) Assignee: Magnetic Torque International, Ltd., Bridgetown (BB)

( * ) Notice: Subject to any disclaimer, the term of this patent is extended or adjusted under 35 U.S.C. 154(b) by 0 days.

This patent is subject to a terminal disclaimer.

(21) Appl. No.: 11/105,417

(22) Filed: Apr. 14, 2005

(65) Prior Publication Data

US 2005/0189264 A1 Sep. 1, 2005

(51) Int. Cl.
*B03C 1/00* (2006.01)

(52) U.S. Cl. ..... 209/213; 209/218; 209/223.1

(58) Field of Classification Search ..... 209/40, 209/213–216, 218, 223.1, 225, 228, 904
See application file for complete search history.

(56) References Cited

U.S. PATENT DOCUMENTS

| | | | | |
|---|---|---|---|---|
| 463,305 | A | 11/1891 | Hoffman | |
| 1,218,916 | A | 3/1917 | Weatherby | |
| 1,889,349 | A | 11/1932 | Buttron | |
| 2,470,889 | A | 5/1949 | Drescher | |
| 2,702,123 | A | 2/1955 | Injeski, Jr. | |
| 4,055,489 | A | 10/1977 | Soley | |
| 4,229,209 | A | 10/1980 | Kindig et al. | |
| 4,273,646 | A | 6/1981 | Spodig | |
| 4,726,895 | A | 2/1988 | Martinez | |
| 5,375,721 | A | 12/1994 | LaVigne | |
| 6,899,230 | B1 * | 5/2005 | Wise | 209/213 |
| 2005/0189263 | A1 | 9/2005 | Wise | |

FOREIGN PATENT DOCUMENTS

| | | |
|---|---|---|
| DE | 311 387 | 3/1919 |
| DE | 600 048 | 7/1984 |
| DE | 297 05 556 | 5/1997 |
| GB | 2 154 474 | 9/1985 |

OTHER PUBLICATIONS

English Translation of DE 311387, Magnetic Dry Separator, patented Nov. 28, 1916.*
XP002200259, (SU1069858), Jan. 30, 1984, Soviet Union.

* cited by examiner

*Primary Examiner*—Joseph C. Rodriguez
(74) *Attorney, Agent, or Firm*—Morgan, Lewis & Bockius, LLP

(57) ABSTRACT

An apparatus for separating non-magnetic mineral values includes first and second conveyers in overlying relation which counter-rotate relative to one another, wherein one of the conveyers includes a magnetic assembly which cooperates with paddles on the upper conveyer to progressively isolate values from magnetic material, and multiple stages are provided for intermittent magnetic interactions such that non-magnetic materials are effectively isolated from magnetic materials.

20 Claims, 6 Drawing Sheets

APPARATUS FOR ISOLATING MATERIALS

This application claims the benefit of U.S. application Ser. No. 09/985,952, filed Nov. 6, 2001, which is hereby incorporated by reference.

BACKGROUND OF THE INVENTION

The present invention relates to a method and apparatus for isolating valuable or toxic substances from a source containing such materials.

It is well known that precious metals and toxic substances can be contained in small amounts in a composite material that may include a mixture of soil, rocks, ores, metals, minerals, tailings, and the like. In the instance of precious metals, the amount of precious metals in a volume of composite materials may be quite small, but the volume of composite materials may be very large. If the precious metals can be extracted to a high degree, substantial and valuable amounts of precious metals can be obtained. Similarly, in the case of toxic substances, their presence in even lower, trace amounts in composite materials can present a similar environmental or human hazard. If not extracted from the large volumes of composite materials, it becomes necessary to dispose of all of the composite materials, which is very costly and greatly impacts the environment. If the toxic substances could be extracted and disposed of separately, the cost of disposal and the environmental problem are greatly reduced.

While extraction devices and processes have been known in the past, frequently they have produced large amounts of polluted water or required special handling in order to perform extraction. This has significantly raised the cost of separation attempts and frequently made it financially unjustifiable to process the large volumes of composite materials in order to extract precious metals or toxic substances. Also, the prior art extraction devices and processes were inefficient resulting in incomplete extraction of precious metals or toxic substances. Accordingly, there is a need for a more efficient extraction method and apparatus as well as a method and apparatus that can be easily transferred and employed at the location of the composite material.

SUMMARY OF THE INVENTION

An object of the present invention is to provide a novel apparatus and method for isolating to a high degree valuable or toxic substances from composite materials containing such valuable or toxic substances in low concentration.

Another object of the present invention is to provide a novel apparatus and method for separating non-magnetic mineral values from a source of composite materials containing magnetic material and non-magnetic material.

A still another object of the present invention is to provide a novel method of dry separation of non-magnetic metal values from a source of material containing the non-magnetic values and other minerals.

A further object of the present invention is to provide an environmentally friendly toxic substance separation apparatus and method.

Additional features and advantages of the invention will be set forth in the description that follows, and in part will be apparent from the description, or may be learned by practice of the invention. The objectives and other advantages of the invention will be realized and obtained by the structure and methods particularly pointed out in the written description and claims hereof as well as the appended drawings.

To achieve these and other advantages and in accordance with the purpose of the present invention, as embodied and broadly described, the present invention provides, in one aspect, an apparatus for separating non-magnetic mineral values from a source material containing magnetic material and non-magnetic material, the apparatus includes a first endless conveyer having a front end and a rear end, the first endless conveyer having a textured surface and having a plurality of spaced apart paddles removably mounted thereon, a second endless conveyer positioned beneath and substantially parallel to the first conveyer in a vertically spaced relationship therewith and having a front end and a rear end, the front end of the second conveyer positioned rearward with respect to the front end of the first conveyer to define a longitudinally staggered relationship between the first conveyer and the second conveyer, the second endless conveyer being configured to receive the source material adjacent its rear end, a motor for driving the first conveyer in a first direction and the second conveyer in a second direction opposite to the first direction such that a bottom surface of the first endless conveyer and a top surface of the second endless conveyer are driven in substantially the same direction from the respective rear ends towards the respective front ends, a first wall and a second wall extending between the first conveyer and the second conveyer substantially along the entire length of each conveyer, the first and second walls, the bottom surface of the first endless conveyer, the top surface of the first endless conveyer, and the paddles collectively forming an enclosure within which the source material is positioned, and a magnetic separation assembly mounted within the first endless conveyer for acting on the source material within the enclosure, the assembly having a frame for supporting discrete sections of magnets, the sections of magnets being mounted to the frame in spaced longitudinal relation to form alternating areas of presence and absence of a magnetic field such that the magnetic separation assembly permits the magnetic fields to intermittently act on the source material to progressively separate the magnetic material from the non-magnetic material as the material is transported along the second endless conveyer within the enclosure.

In another aspect, the present invention provides An apparatus for separating non-magnetic mineral values from a source material containing magnetic material and non-magnetic material, the apparatus includes a first endless conveyer having a front end and a rear end, the first endless conveyer having a plurality of spaced apart paddles removably mounted thereon, a second endless conveyer positioned beneath and substantially parallel to the first conveyer in a vertically spaced relationship therewith and having a front end and a rear end, a motor for driving the first conveyer in a first direction and the second conveyer in a second direction opposite to the first direction such that a bottom surface of the first endless conveyer and a top surface of the second endless conveyer are adjacent, a first wall and a second wall extending between the first conveyer and the second conveyer substantially along the entire length of each conveyer, and a magnetic separation assembly mounted within the first endless conveyer for acting on the source material, the assembly having a frame for supporting discrete sections of magnets, the sections of magnets being mounted to the frame in spaced longitudinal relation to intermittently act on the source material to progressively separate the magnetic material from the non-magnetic material as the material is transported along the second endless conveyer.

In another aspect, the present invention provides an apparatus for separating non-magnetic mineral values, the apparatus includes a first endless conveyer having a front end and a rear end, the first endless conveyer having a plurality of spaced apart paddles mounted thereon, a second endless conveyer positioned beneath and substantially parallel to the first conveyer in a vertically spaced relationship therewith and having a front end and a rear end, a motor for driving the first conveyer in a first direction and the second conveyer in a second direction opposite to the first direction, a first wall and a second wall extending between the first conveyer and the second conveyer substantially along the entire length of each conveyer, and a magnetic separation assembly mounted within the second endless conveyer belt 13. The first endless conveyer belt 11 has a first end 35 (front end) and a second end 37 (rear end) and is moved by a conventional motor system 10 in a first direction, for example a clockwise direction, as shown by the arrow 33. The rear end 39 of the second conveyer receives composite material (source material) in this preferred embodiment. Side walls 42 are provided in either side of the conveyers such that walls 42, the bottom surface of the first endless conveyer belt 11, and the top surface of the second endless conveyer belt 13 together form an enclosure within which the source material is located. While side wall 42 is depicted as transparent in FIG. 1 to show the interior, of course, an opaque side wall 42 may also be employed.

As used herein, the composite material is intended to include a mixture of dirt, ores, rock, tailings, and/or other material that includes both magnetic material, such as ferrous metals and minerals, and non-magnetic material, such as non-ferrous metals and minerals. In some instances, the composite material may include toxic minerals or metals in trace amounts per unit volume.

In this example, the composite material is discharged to the rear end 39 of the second endless conveyer belt 13. If desired, the composite material may instead be loaded onto the top surface of the first endless conveyer 11 at its first first endless conveyer for acting on a source material, the assembly having a frame for supporting discrete sections of magnets, the sections of magnets being mounted to the frame in spaced longitudinal relation to intermittently act on the source material to progressively separate magnetic material from non-magnetic material as the material is transported along the second endless conveyer.

It is to be understood that both the foregoing general description and the following detailed description are exemplary and explanatory, and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
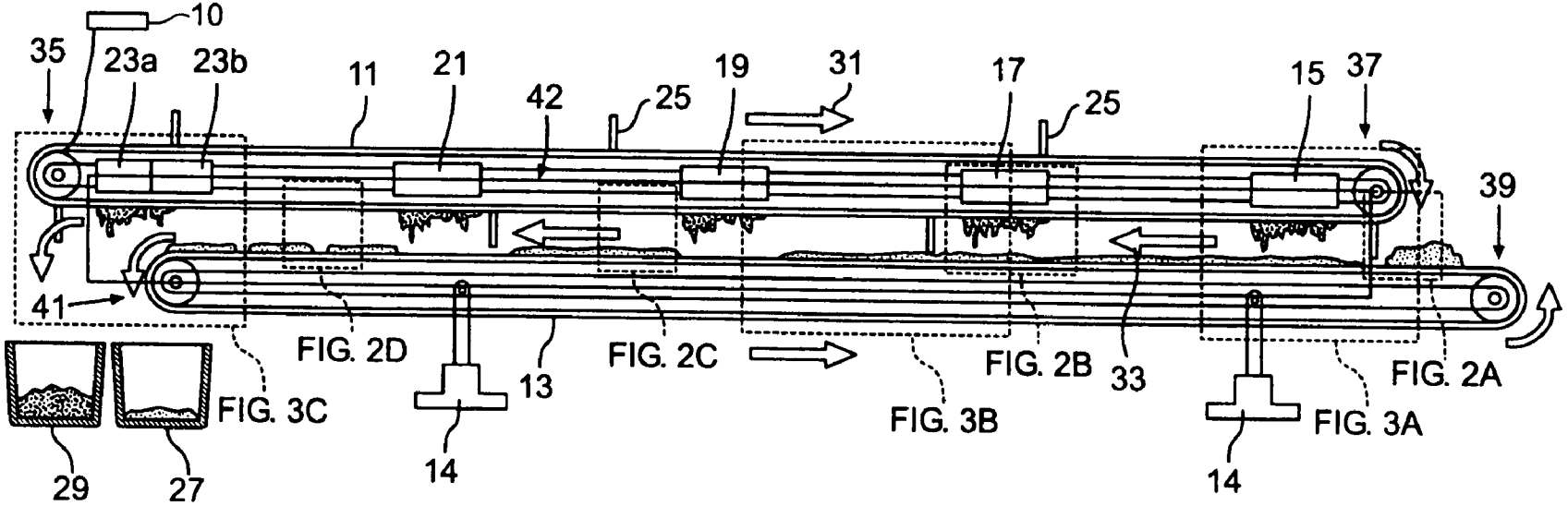
FIG. 1 is a side view of a dry magnetic separating apparatus according to an embodiment of the present invention.

With reference to FIG. 1, a first endless conveyer belt 11 is shown to be vertically disposed with respect to a second endless conveyer belt 13. This is a preferred disposition of the first endless conveyer belt 11 with respect to the end 35 and discharged from the second end 37 of the first endless conveyer belt 11 to the rear end 39 of the second endless conveyer belt 13. Also, depending upon design choice, the composition material may be loaded anywhere on the top surface of the first endless conveyer 11.

The second endless conveyer belt 13 includes a second end 41 (front end) and is moved by a suitable motor (not shown) in a second direction shown by the arrow 33, for example, a counterclockwise direction. As shown in FIG. 1, the path of the second endless conveyer belt 13 is substantially aligned with the path of the first endless conveyer belt 11. Moreover, in this preferred embodiment, the first endless conveyer built 11 moves at a higher speed, for example 30 rpm, 40 rpm, etc., than the speed of the second endless conveyer belt 13, for example 10 rpm.

A series of magnets 15, 17, 19, 21, and 23 (including magnets 23*a* and 23*b*) are provided in a space defined by the first endless conveyer belt 11. These magnets are commercially available, strong magnets having magnetic Gauss Oersteds ($MGO_e$) of 27 or higher. In this example, the front end side of magnets 23*a* and 23*b* are provided to increase the magnetic field strength to ensure effective attraction of the magnetic materials from the source.

Preferably, at least the surface of the first endless conveyer belt 11 in contact with the composite material has a textured surface. Similarly, the surface of the second endless conveyer belt 13 may have a textured surface. The composite material is discharged at the rear end 39 of the second endless conveyer belt 13. As the composite material moves from the first (rear) end 39 toward the second (front) end 41 of the second endless conveyer belt 13, the material passes underneath the magnets 15, 17, 19, 21, 23*a* and 23*b* and is subjected to the strong magnetic fields of these magnets. As the composite material passes underneath these magnets, magnetic materials, such as ferrous metals and minerals, are attracted to the magnets, and non-magnetic material, such as non-ferrous metals and minerals, are not attracted and remain on the second endless conveyer belt 13. The magnets are of such strength that the magnetic metals and minerals attracted thereto remain proximate the magnets despite the continuing movement of the first endless conveyer belt 11.

Thus, the textured surface of the first endless conveyer belt 11 slides between the magnets and the materials attracted to the magnets because the materials attracted to the magnets remain proximate thereto until they are scraped in the direction of the movement of the first endless conveyer belt 11 by one of the paddles 25.

The non-magnetic materials, for example non-ferrous metals and minerals, remain on the second endless conveyer belt 13 and continue to move in the direction of the arrow 33. As the first endless conveyer belt rotates, paddles 25 will be intermittently moved past the locations of the magnets. The magnetic materials attracted to the magnets are pushed by the paddles 25 away from the magnets and out of the magnetic fields of the magnets. As the magnetic materials are pushed by the paddles 25, they fall back to the surface of the second endless conveyer belt 13 on top of the non-magnetic materials that had remained on the second endless conveyer belt 13. As a consequence, the magnetic materials form a layer on top of the non-magnetic materials that were not attracted to the magnets. In this way, as the composite material traverses the second endless conveyer belt from the first end 39 to the second end 41, the composite materials become stratified with the magnetic materials being layered on top of the non-magnetic materials residing on the surface of the second endless conveyer belt 13.

Figure 2D:
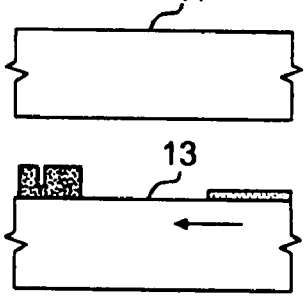
FIGS. 2A, 2B, 2C, and 2D are enlarged drawings of the areas 2A, 2B, 2C, and 2D, respectively, shown in FIG. 1.
Figure 2C:
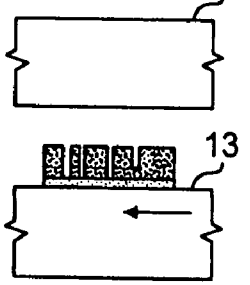
Figure 2B:
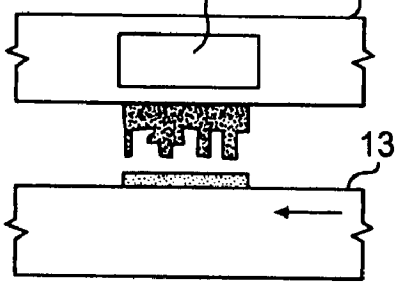
Figure 2A:
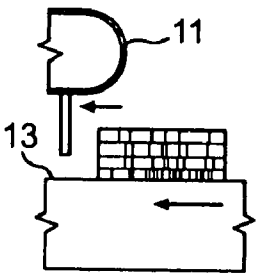

The stratification of the composite material is illustrated in FIGS. 2A through 2D. FIG. 2A corresponds to the area 2A identified in FIG. 1. FIG. 2A schematically shows the composite materials before passing into the magnetic field of the first magnetic 15. FIG. 2B is an enlarged view of the area 2B of FIG. 1. FIG. 2B schematically illustrates the magnetic materials, such as the ferrous metals and minerals, being attracted to the magnet 17 with the non-magnetic materials, such as non-ferrous metals and minerals, remaining on the surface of the second endless conveyer belt 13. FIG. 2C is an enlarged view of the area 2C of FIG. 1. FIG. 2C schematically illustrates the stratification of the composite materials. The upper layers of the composite materials comprises magnetic materials and the lower layers of the composite materials comprises non-magnetic materials. FIG. 2D is an enlarged view of the area 2D shown in FIG. 1. FIG. 2D further illustrates the stratification of the composite materials as a result of passing by the magnets 15, 17, 19, and 21.

It can be understood that the number of magnets provided within the first endless conveyer belt is a matter of design choice. The distance between the magnets is also a matter of design choice depending upon the strengths and sizes of the magnets provided. The proper distance between the magnets is maintained by a structure sufficiently strong to support the magnets. Further, if it is desirable to have a larger intensity of the magnetic fields at the surface of the second endless conveyer belt 13 due to the nature of the materials processed or for some other reasons, the distance between the first endless conveyer belt 11 and the second endless conveyer belt 13 may be reduced. In such a case, it may be necessary to reduce the height of the paddles 25 on the first endless conveyer belt 11 so as to avoid undesirable interference with the second endless conveyer belt 13 and the materials thereon. In the preferred embodiment, adjustable supports 14 are provided (FIG. 1) so that the second endless conveyer belt 13 may be adjustably located beneath the first endless conveyer belt 11. The adjustable supports 14 may include a cam mechanism or the like for adjusting the vertical position of the second endless conveyer belt 13 relative to the first endless conveyer belt 11. Of course, in the alternative, the vertical position of the first endless conveyer belt 11 may be adjusted while the second endless conveyer belt 13 is fixed, or both conveyer belts 11 and 13 may be made vertically movable to adjust the distance therebetween to produce a desired intensity of the magnetic fields.

Also, the height of the paddles 25 may be adjusted to scrape a top layer of the pile of the materials in order to provide efficient, uniform exposure of the material on the second endless conveyer 13 to the magnetic fields.

It is necessary that the selection of the magnets and the spacing therebetween permit the magnetic material to fall back to the second endless conveyer belt 13 before it is attracted to the next downstream magnet. Further in this example, as shown in FIG. 1, the final magnet 23 includes double magnets 23*a* and 23*b*. The magnets 23*a* and 23*b* attract for the final time the magnetic materials that have been separated to be at the upper strata of the composite materials. The materials left on the second endless conveyer belt 13 comprise the lower portion of the strata and are substantially comprised of non-magnetic materials, such as non-ferrous metals and minerals. These materials, conventionally called browns, fall into the first hopper 27 from the second end 41 of the second endless conveyer belt 13. The materials that are discharged into the second hopper 29 from the first endless conveyer 11 are conventionally called blacks.

Figure 3A:
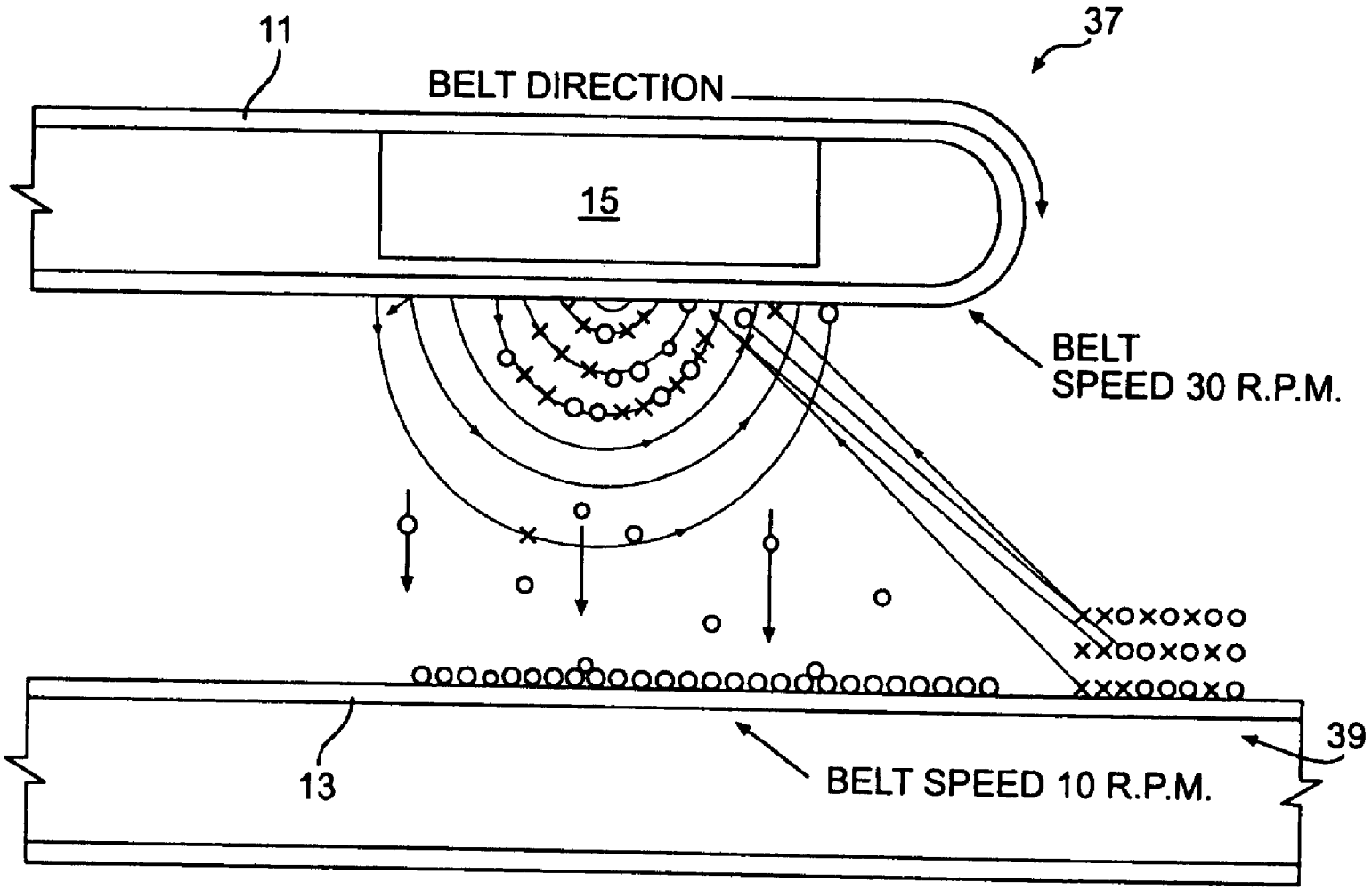
FIG. 3A is an enlarged schematic view of the area 3A of FIG. 1.

FIG. 3A is an enlarged schematic view of the area generally designated 3A in FIG. 1. As shown in FIG. 3A, the field of the magnet 15 attracts magnetic materials, such as ferrous metals and minerals, represented by X's and does not attract the non-magnetic materials, such as non-ferrous metals and minerals, represented by O's. The textured surface of the first endless conveyer belt 11 causes a churning or tumbling of the composite material that is attracted to the first magnetic 15 as the belt 11 slides between the magnet 15 and the magnetic material attracted thereto. This churning or tumbling motion enables more of the non-magnetic materials to drop to the surface of the second endless conveyer belt 13. In the development of the present invention, the present inventor discovered that with respect to highly conductive non-magnetic material, such as gold, magnets having an $MGO_e$ of greater than or equal to 27 effectively repel particles of such material entrapped in the composite material so that those particles will easily drop to the surface of the second endless conveyer belt 13. The effect is particularly strong in the case of gold particles.

This is believed to be due to the induction effects of the strong magnetic field. The churning or tumbling motion and other motions of the gold particles due to the movements of the endless conveyers create time-varying magnetic field as seen by the gold particles. This time-varying magnetic field induces the surface currents on the gold particles, which in turn create magnetic fields that are repulsive to the magnetic field created by the magnet 15. Further, the magnetic field enhances the particles' tendency to aggregate into larger particles, which are easily separated from the rest. These effects are particularly useful in forcefully separating metal particles attached to magnetic particles. Thus, gold and other precious metals, which are typically highly conductive, can efficiently be separated by virtue of this mechanism.

Figure 3B:
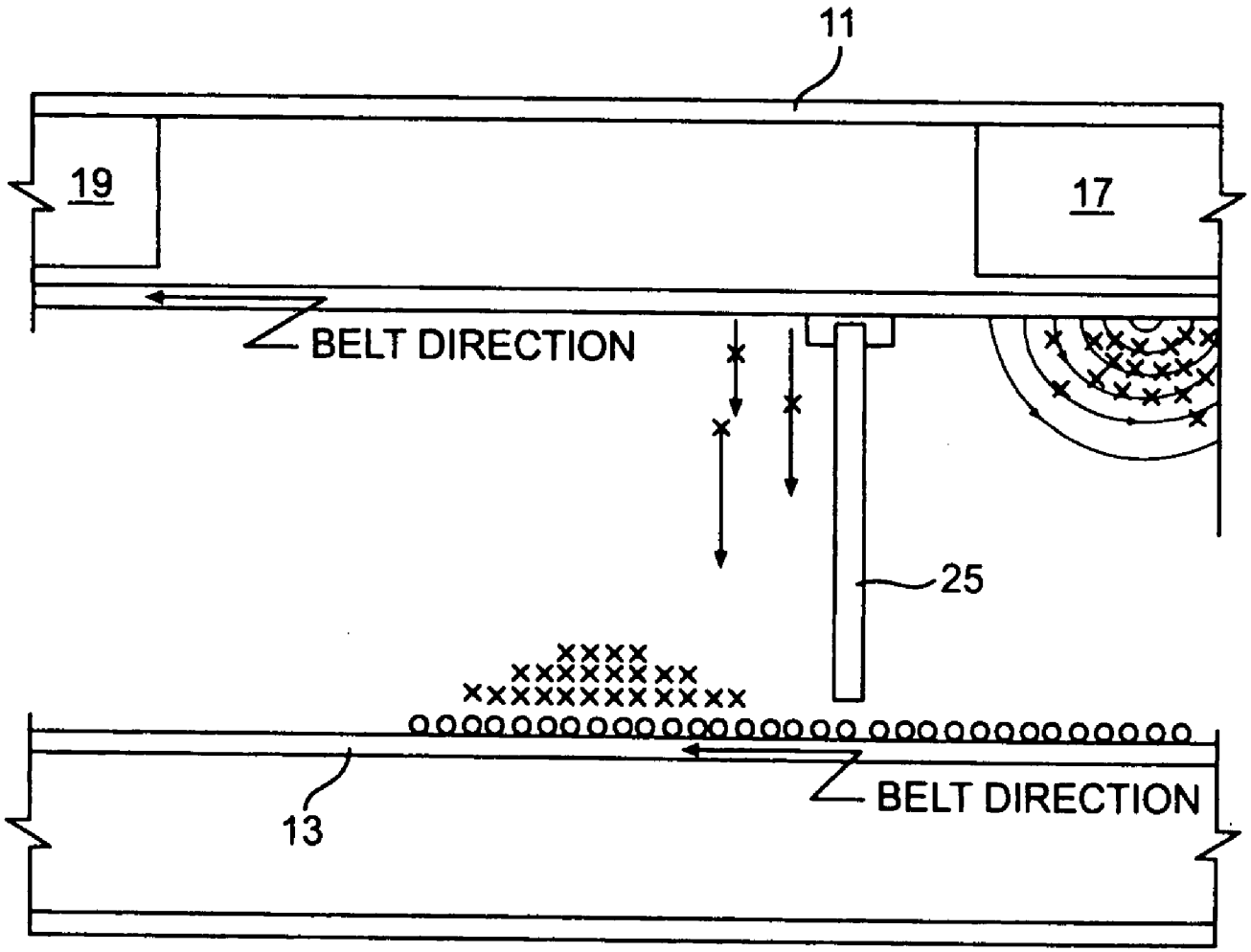
FIG. 3B is an enlarged schematic view of the area 3B of FIG. 1.

FIG. 3B is an enlarged schematic view of the area generally designated 3B in FIG. 1. As shown in FIG. 3B, the paddle 25 has just passed the magnet 17 and has pushed the magnetic material that was attracted to the magnet 17 to be out of the field of the magnet 17 until the magnetic materials fall back to the surface of the second endless conveyer belt 13 on top of the layer of non-magnetic materials. As seen from FIG. 3B, this causes further stratification of the composite material with the magnetic (e.g., ferrous) metals and minerals laying on top of the non-magnetic (e.g., non-ferrous) metals and minerals.

Figure 3C:
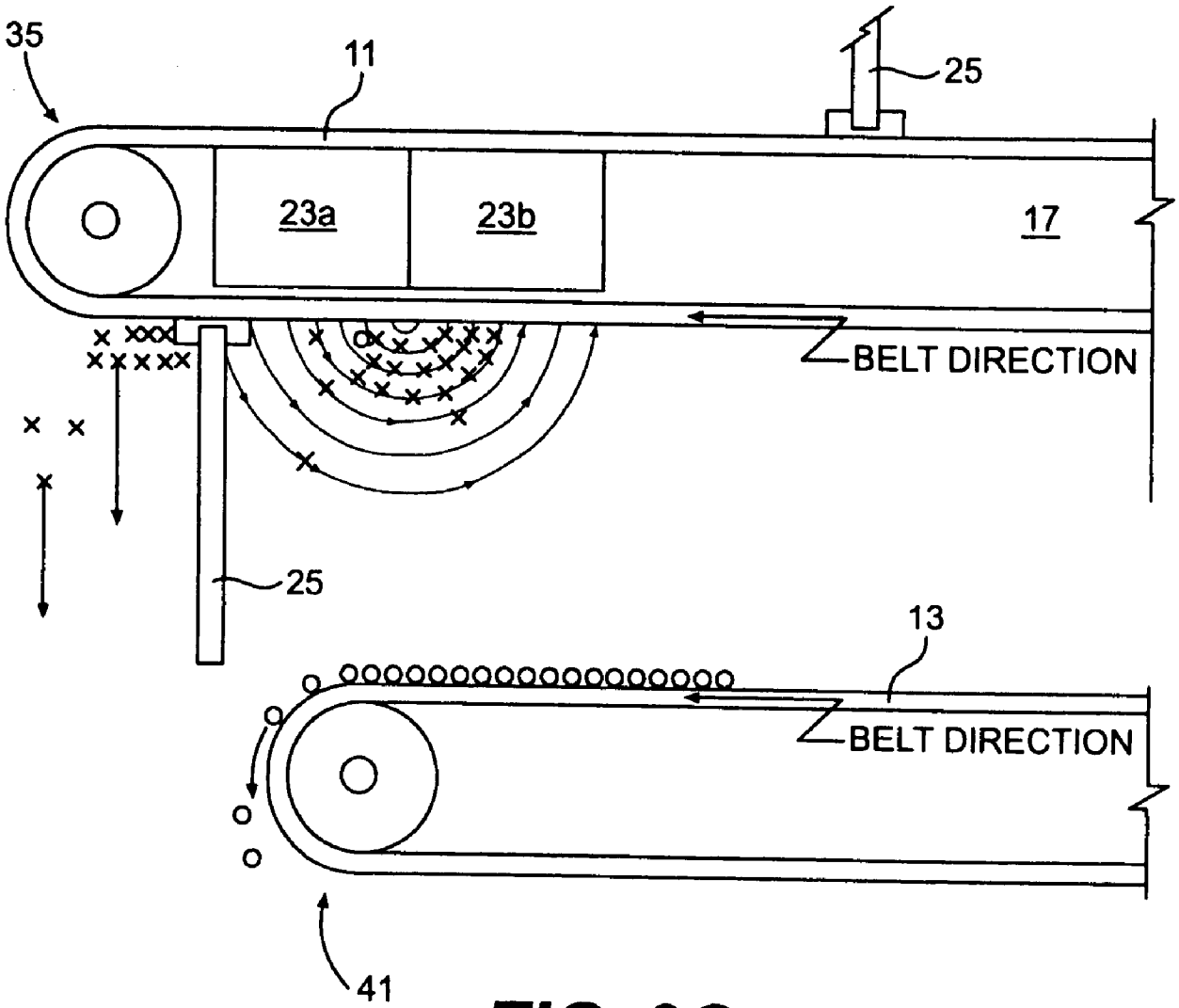
FIG. 3C is an enlarged schematic view of the area 3C of FIG. 1.

FIG. 3C is an enlarged schematic view of the area generally designated 3C in FIG. 1. The double magnets 23*a* and 23*b* are shown as holding within their magnetic fields the magnetic materials. The non-magnetic materials drop from the second (front) end 41 of the second endless conveyer belt 13 into the hopper 27. The paddle 25 pushes off the magnetic materials that had been attracted to the magnets 23*a* and 23*b* such that those materials will fall into the hopper 29.

Figure 4:
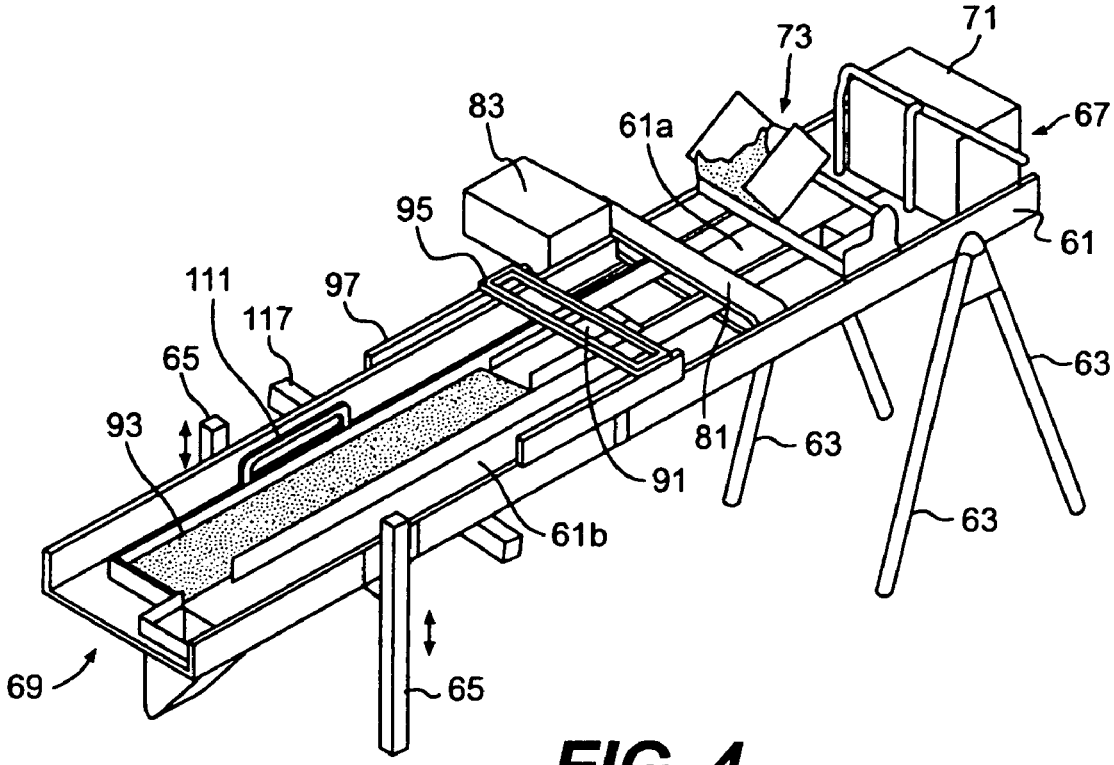
FIG. 4 is a perspective view of a wet magnetic separating apparatus according to an embodiment of the present invention.

FIG. 4 shows a wet separation apparatus that comprises another aspect of an embodiment of the present invention. This wet separation apparatus can be used independently, or can be used to further process the browns separated through the use of the apparatus of FIG. 1. The apparatus of FIG. 4 is particularly effective to separate gold and other precious non-ferrous metals from the browns deposited in the first hopper 27.

The wet separator apparatus of FIG. 4 includes a bed 61 supported by rear legs 63 and front legs 65. The rear legs 63 may be fixed to support the bed 61 in a particular height and the front legs 65 are adjustable via a crank or other mechanism (not shown) to adjust the legs in a vertical direction or height as indicated by the arrows shown in FIG. 4. As is readily understood, vertical adjustment of the legs 65 permits the selection of the slope of the bed 61 from a first (rear) end 67 to a second (front) end 69. At the first end of the bed 67 is located a source of water 71 that will result in a steady stream of water flowing along a first bed channel 61*a* from near the first end 67 to the second end 69. The water may be discharged from the source 71 at a selectable rate, for example, 60 gallons per minute, to form a continuous stream of water through the first bed channel 61*a*.

Figure 5:
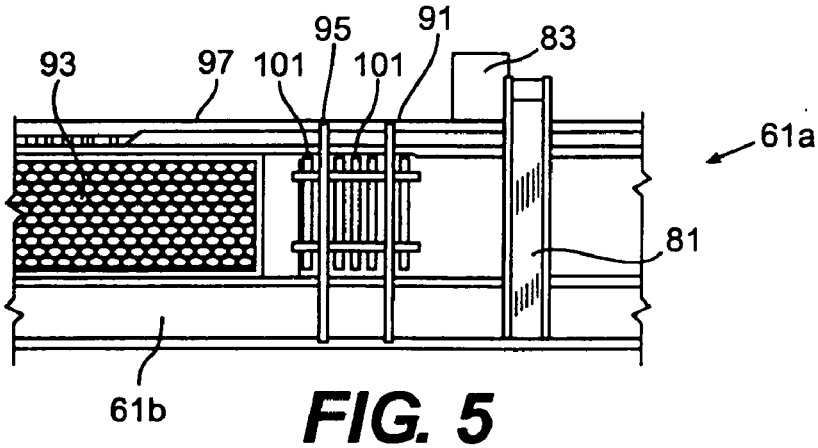
FIG. 5 is an enlarged view of a portion of the apparatus of FIG. 4.

Downstream of the water source 71 is a feeder 73 for supplying a source material, such as the browns that have been separated by the apparatus shown in FIG. 1, for example. This feeder 73 may be of any conventional type and is intended to discharge the browns evenly into the first bed channel 61*a* of the bed 61. The browns are discharged into the flowing water in the first bed channel 61*a*. The browns are carried by the stream of water beneath a rotating magnetic cross belt 81 that is driven by a motor 83. As shown in FIG. 5, the magnetic cross belt 81 rotates in the direction of the arrow shown in FIG. 5 and permits additional magnetic materials to be attracted to the cross belt 81 from the browns that are flowing in the first bed channel 61*a*. This is particularly important if the wet separator of FIG. 4 is not processing browns that have previously been processed by the dry separator of FIG. 1.

Downstream of the magnetic cross belt 81 is a magnetic separator 91 and a mesh area 93. As shown in FIG. 5, the magnet separator 91 is comprised of a number of magnetic bars 101 of high strength magnetic material, e.g., magnets having an $MGO_e$ greater than or equal to 27. FIG. 5 shows the magnet separator 91 disposed upstream of the mesh area 93. This is accomplished by movement of a carriage 95 supporting the magnetic separator 91 on rails 97 located on either side of the bed 61. In a preferred mode of operation, the magnetic separator 91 is placed such that the upstream edge of the magnetic separator 91 is approximately coincident with the upstream edge of the mesh area 93.

Figure 6:
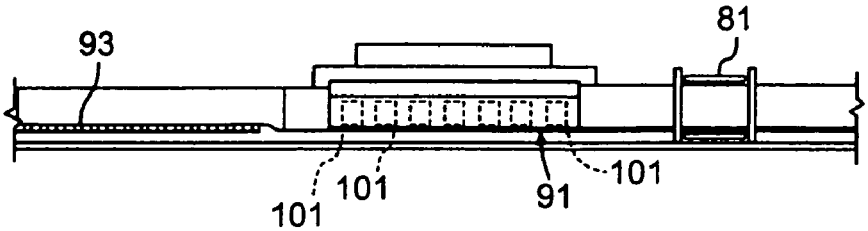
FIG. 6 is a side view of the apparatus of FIG. 5.

FIG. 6 is a side view of a portion of the wet separator apparatus of FIG. 4 and shows, in particular, the bars 101 of the magnetic separator 91, downstream thereof, and the upstream portion of the mesh 93. The proper distance between the magnetic bar 101 can be maintained by a frame sufficiently strong to support the magnets, for example.

Figure 7:
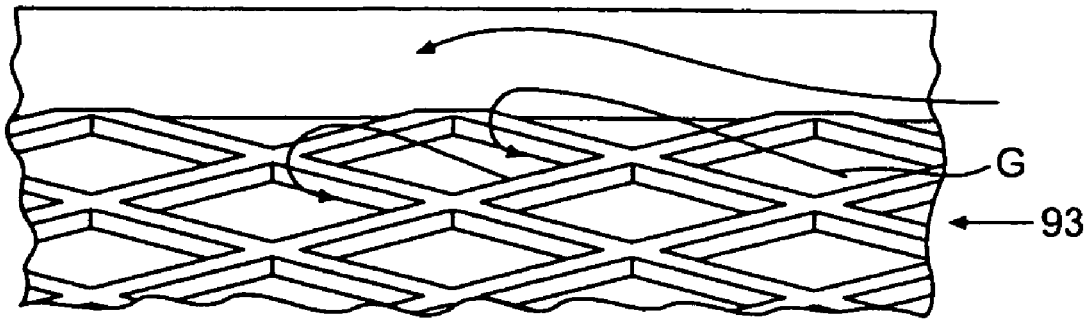
FIG. 7 is an enlarged view of a portion of a mesh belt used in the wet separating apparatus of FIG. 4.

FIG. 7 is an enlarged view of a portion of the mesh 93. In its preferred form, the mesh is a diamond pattern. When the magnetic separator 91 is placed such that its upstream edge is substantially coincident with the upstream edge of the mesh 93, the magnetic field of the magnetic separator 91 including magnets of the above-stated strength repels gold particles present in the materials carried by the flowing stream of water against the flow of the water stream and into the upstream corners of the mesh pattern as shown in FIG. 7. This desirable repulsion effect occurs by the mechanism similar to the repulsion mechanism described above with reference to FIG. 3A. That is, the repulsion effect is caused by the induction currents created by the time-varying magnetic field felt by the gold particles in the stream. Further, the magnetic field enhances the tendency of gold particles to aggregate into larger particles, which are easily trapped in the mesh 93. It is believed that this also is attributed to the induction current effects described above. Similar phenomena occurs with respect to other conductive, non-magnetic materials.

It can be understood that the configuration of the magnet bars 101 in the magnetic separator 91 and the lateral and vertical placements of the magnetic separator 91 relative to the mesh 93 are a matter of design choice depending upon other parameters, such as the flow rate in the water stream, etc., which in turn should be adjusted in accordance with the materials to be processed.

Examples of the mesh 93 that can be used to create an efficient trapping environment for the precious metals include, but are not limited to, Hungarian riffles, reticulated mats having other patterns, etc. As shown in the preferred embodiment above, the reticulated mat having a diamond pattern is preferred for efficiently generating localized vortices, thereby providing better trapping effects. The dimensions of the diamond pattern and its height can be selected depending upon the content and volume of the material processed and the flow rate of the stream to achieve efficient capturing of desired minerals.

The gold particles G accumulate in these upstream portions as more and more of the browns are carried in the water stream from the supply 71 to the second end 69 of the wet separator. The constituent materials of the browns that are not entrapped in the mesh 93, e.g., the materials other than gold, are discharged from the second end 69 of the first bed channel 61*a* and may be disposed of.

Figure 8:
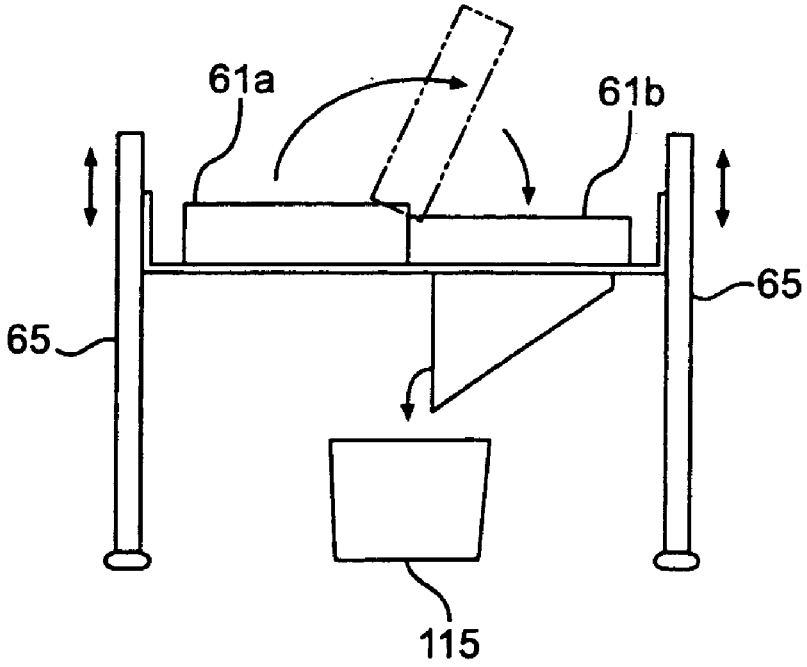
FIG. 8 is an end view of the apparatus of FIG. 4.

After processing a selected volume of the browns through the wet separator apparatus of FIG. 4, the feeding of the water and the browns is stopped in order to recover the gold particles trapped in the mesh 93. This may be accomplished as shown in FIG. 8 by rotating the first bed channel 61*a* clockwise by use of the handle 111 (FIG. 4) until it is over a second bed channel 61*b*. The mesh 93 may be rinsed to cause the gold particles to be moved into the second bed channel 61*b*. The gold particles can be discharged into a collection box 115 (FIG. 8) from the second bed channel 61*b*.

It is contemplated that the mesh 93 may be divided into a first section (upstream) and a second section (downstream). This is advantageous because the field of the magnetic separator 91 has its greatest effect on gold particles passing in the upstream section of the mesh 93 with the consequence that more pure gold particles will be trapped in an upstream portion of the mesh 93 than in a downstream portion. In this instance, the upstream portion of the mesh 93 may be separately cleaned from the downstream of the mesh 93 by separately rotating those portions and rinsing them. The gold particles from the upstream portion of mesh 93 would be discharged by a suitable discharge chute communicating with an upstream portion of the second bed channel 61*b*. The materials trapped in the downstream portion of the mesh 93 could be rinsed into the downstream portion of the second bed channel 61*b* and collected in a separate container. The materials recovered from this second container could then be run through the wet separator apparatus again.

Furthermore, as shown in FIG. 4, one or more of additional auxiliary magnet elements 117 containing one or more of magnetic bars 101 or other magnets with a high magnetic strength may be removably provided under (or over) the mesh 93 in the downstream side of the magnetic separator 91 to provide additional trapping effects.

One of the unique aspects of the present invention is that the magnetic fields actually act on nonferrous materials. When a source material passes through the equipment chambers a magnetic action occurs. The fine and ultra fine metals and minerals are slowed and attracted to each other. Then as the feedstock materials pass out of the magnet chamber, the specific gravity of the metals and minerals takes effect and, with back eddies that are being created, are captured in riffles on the decks of the equipment.

In this embodiment, only plain water (which can often be recirculated) and a relatively small amount of power are required.

The separation apparatus as embodied in the examples above may be constructed of appropriately designed modular components so that the apparatus may be easily transported to operation locations and assembled reliably and efficiently. A working model, which was constructed in such a modular design, allows processing of 1 ton per hour up to 100 tons per hour or more depending on project requirements and the nature of the materials. Of course, a more permanently based, large scale processing line may be constructed for use at large processing sites as the need arises.

As described above, while passing through chambers having magnetic field strengths in excess of 27 $MGO_e$, the present invention causes physical effects on certain nonferrous materials causing high efficiency separation of the ferrous and non-ferrous materials. As shown in the examples above, processing is accomplished in a wet or dry mode depending on the nature of the materials. A separation system may be constructed by combining the above-described dry system and wet system. Depending upon the nature and content of the source material, the source material and the target material may be introduced and collected, respectively, in various appropriate stages of the combined separation system.

Using the apparatuses and methods of the present invention described above, similar high-degree separation can be achieved with respect to not only gold, but also other precious metals, such as platinum, mercury, palladium, etc., or toxic minerals.

Environmentally Friendly Toxic Substance Separation

It is particularly contemplated that the material separations systems and methods of the present invention disclosed above can be used in isolating toxic substances and contaminants, such as mercury, most lead materials, antimony, and sulfides from soil or sediments that are naturally occurring or artificially created. Utilizing the present novel magnetic technology described above, separation of these heavy media contaminants and minerals can be effectuated at a lower cost with a high efficiency. Particularly noteworthy is that, as compared with the conventional chemical separation methods, systems according to the present invention yields no adverse environmental impact.

According to this aspect of the present invention, separation apparatus and method of the present invention enable efficient and environmentally friendly separation and recovery, from a host of ferrous and non-ferrous metals, of mercury, certain lead minerals and a variety of other contaminants on the environmental cleanup sites, as well as gold, silver, platinum and other commercial products that may be present.

The separation system of the present invention actually removes contaminants from the soil, eliminating the hazardous materials, as opposed to merely covering them up, allowing for a safer and restriction free use of previously contaminated property, for example. Furthermore, the separation system of the present invention often recovers, in a significant amount, metals or other valuable that other separation schemes leave behind. In certain cases, the potential recovery can well exceed the cost of clean up.

Operational sites of the present invention include superfund sites, abandoned mines and mill sites, tailing dumps and deposits of naturally occurring contaminants, as well as contamination resulting from a variety of industrial or governmental operations.

The modular design of the apparatus described above allows for the proper allocation of equipment regardless of the scope of the project. This increases efficiency on the operations side while eliminating costs relating to excess "hardware." This modular approach also reduces manpower expenditures, requiring only that number of technicians necessary to run the appropriate number of machines. Thus, depending upon the size and nature of a particular cleanup or metal value separation project, the actual costs may very. Yet, as compared with the conventional technologies, it is apparent that the present invention provides for highly cost-efficient, environmentally clean schemes for toxic substance removal and metal values separation.

It will be apparent to those skilled in the art that various modifications and variations can be made in the separating method and apparatus of the present invention without departing from the spirit or scope of the invention. Thus, it is intended that the present invention cover the modifications and variations of this invention provided they come within the scope of the appended claims and their equivalents.

What is claimed is:

1. An apparatus for separating non-magnetic mineral values from a source material containing magnetic material and non-magnetic material, the apparatus comprising:

a first endless conveyer having a front end and a rear end, the first endless conveyer having a textured surface and having a plurality of spaced apart paddles removably mounted thereon;

a second endless conveyer positioned beneath and substantially parallel to the first conveyer in a vertically spaced relationship therewith and having a front end and a rear end, the front end of the second conveyer positioned rearward with respect to the front end of the first conveyer to define a longitudinally staggered relationship between the first conveyer and the second conveyer, the second endless conveyer being configured to receive the source material adjacent its rear end;

a motor for driving the first conveyer in a first direction and the second conveyer in a second direction opposite to the first direction such that a bottom surface of the first endless conveyer and a top surface of the second endless conveyer are driven in substantially the same direction from the respective rear ends towards the respective front ends;

a first wall and a second wall extending between the first conveyer and the second conveyer substantially along the entire length of each conveyer, the first and second walls, the bottom surface of the first endless conveyer, the top surface of the first endless conveyer, and the paddles collectively forming an enclosure within which the source material is positioned; and a magnetic separation assembly mounted within the first endless conveyer for acting on the source material within the enclosure, the assembly having a frame for supporting discrete sections of magnets, the sections of magnets being mounted to the frame in spaced longitudinal relation to form alternating areas of presence and absence of a magnetic field such that the magnetic separation assembly permits the magnetic fields to intermittently act on the source material to progressively separate the magnetic material from the non-magnetic material as the material is transported along the second endless conveyer within the enclosure.

2. The apparatus according to claim 1, wherein the magnetic separation assembly is removably mounted within the first endless conveyer.

3. The apparatus according to claim 1, further comprising an adjustable support for supporting the first endless conveyer and the second endless conveyer such that the first and second endless conveyers are adjustable vertically relative to one another.

4. The apparatus according to claim 1, wherein the magnetic separation assembly includes, adjacent the front end of the first endless conveyer, a magnetic section having about twice the magnetic field strength of the other of the magnetic sections.

5. The apparatus according to claim 1, wherein the motor drives the first conveyer and the second conveyer at a speed ratio of about 4:1.

6. The apparatus according to claim 1, wherein the magnetic sections are made of substantially the same magnet composition.

7. The apparatus according to claim 1, wherein at least some of the magnetic sections are made of different magnet compositions.

8. The apparatus according to claim 1, wherein the first endless conveyer is configured to receive the source material on a top surface thereof and discharge the source material on a top surface of the second endless conveyer at the rear end thereof.

9. An apparatus for separating non-magnetic mineral values from a source material containing magnetic material and non-magnetic material, the apparatus comprising:

a first endless conveyer having a front end and a rear end, the first endless conveyer having a plurality of spaced apart paddles removably mounted thereon;

a second endless conveyer positioned beneath and substantially parallel to the first conveyer in a vertically spaced relationship therewith and having a front end and a rear end;

a motor for driving the first conveyer in a first direction and the second conveyer in a second direction opposite to the first direction such that a bottom surface of the first endless conveyer and a top surface of the second endless conveyer are adjacent;

a first wall and a second wall extending between the first conveyer and the second conveyer substantially along the entire length of each conveyer; and a magnetic separation assembly mounted within the first endless conveyer for acting on the source material, the assembly having a frame for supporting discrete sections of magnets, the sections of magnets being mounted to the frame in spaced longitudinal relation to intermittently act on the source material to progressively separate the magnetic material from the non-magnetic material as the material is transported along the second endless conveyer.

10. The apparatus according to claim 9, wherein the magnetic separation assembly is removably mounted within the first endless conveyer.

11. The apparatus according to claim 9, further comprising an adjustable support for supporting the first endless conveyer and the second endless conveyer.

12. The apparatus according to claim 11, wherein the first and second endless conveyers are adjustable vertically relative to one another.

13. The apparatus according to claim 9, wherein the magnetic separation assembly includes a first magnetic section having a first magnetic field strength different from magnetic field strengths of the other of the magnetic sections.

14. The apparatus according to claim 13, wherein the first magnetic field is about twice the magnetic field strength of the other of the magnetic sections.

15. The apparatus according to claim 13, wherein the magnetic separation assembly is adjacent the front end of the first endless conveyer.

16. The apparatus according to claim 9, wherein the motor drives the first conveyer and the second conveyer at a speed ratio of more than about 1:1.

17. The apparatus according to claim 16, wherein the motor drives the first conveyer and the second conveyer at a speed ratio of about 4:1.

18. The apparatus according to claim 9, wherein the magnetic sections are made of substantially the same magnet composition.

19. The apparatus according to claim 9, wherein at least some of the magnetic sections are made of different magnet compositions.

20. An apparatus for separating non-magnetic mineral values, the apparatus comprising:

a first endless conveyer having a front end and a rear end, the first endless conveyer having a plurality of spaced apart paddles mounted thereon;

a second endless conveyer positioned beneath and substantially parallel to the first conveyer in a vertically spaced relationship therewith and having a front end and a rear end;

a motor for driving the first conveyer in a first direction and the second conveyer in a second direction opposite to the first direction;

a first wall and a second wall extending between the first conveyer and the second conveyer substantially along the entire length of each conveyer; and a magnetic separation assembly mounted within the first endless conveyer for acting on a source material, the assembly having a frame for supporting discrete sections of magnets, the sections of magnets being mounted to the frame in spaced longitudinal relation to intermittently act on the source material to progressively separate magnetic material from non-magnetic material as the material is transported along the second endless conveyer.

* * * * *